US006778101B2

(12) United States Patent
Turbeville et al.

(10) Patent No.: US 6,778,101 B2
(45) Date of Patent: Aug. 17, 2004

(54) EMERGENCY VEHICLE DETECTION SYSTEM

(76) Inventors: Terry A. Turbeville, 13009 Settlers Point Trail, Goshen, KY (US) 40026; John R. Majka, 5917 Six Mile La., Louisville, KY (US) 40218

( * ) Notice: Subject to any disclaimer, the term of this patent is extended or adjusted under 35 U.S.C. 154(b) by 0 days.

(21) Appl. No.: 10/305,496

(22) Filed: Nov. 27, 2002

(65) Prior Publication Data

US 2003/0102985 A1 Jun. 5, 2003

Related U.S. Application Data

(60) Provisional application No. 60/334,427, filed on Nov. 30, 2001.

(51) Int. Cl.[7] ..... G08G 1/00
(52) U.S. Cl. ..... 340/902; 340/901; 340/905
(58) Field of Search ..... 340/902, 901, 340/904, 905; 455/59; 701/117

(56) References Cited

U.S. PATENT DOCUMENTS

| | | | | |
|---|---|---|---|---|
| 3,673,560 | A | | 6/1972 | Barsh et al. |
| 3,710,313 | A | | 1/1973 | Kimball et al. |
| 3,784,970 | A | | 1/1974 | Simpkin |
| 3,859,623 | A | | 1/1975 | Koehler |
| 3,873,963 | A | | 3/1975 | Neal et al. |
| 4,238,778 | A | | 12/1980 | Ohsumi |
| 4,438,429 | A | | 3/1984 | Park |
| 4,764,978 | A | | 8/1988 | Argo et al. |
| 5,307,060 | A | | 4/1994 | Prevulsky et al. |
| 5,495,243 | A | | 2/1996 | McKenna |
| 5,497,148 | A | * | 3/1996 | Oliva ..... 340/905 |
| 5,559,508 | A | | 9/1996 | Orr |
| 5,612,685 | A | * | 3/1997 | Oliva ..... 340/901 |
| 5,635,921 | A | | 6/1997 | Maxwell et al. |
| 5,739,767 | A | | 4/1998 | Carr |
| 5,757,284 | A | | 5/1998 | Trizzino et al. |
| 5,808,560 | A | | 9/1998 | Mulanax |
| 5,825,304 | A | | 10/1998 | Marin |
| 5,889,475 | A | | 3/1999 | Klosinski |
| 5,894,279 | A | | 4/1999 | Rose |
| 5,926,112 | A | | 7/1999 | Hartzell |
| 5,926,114 | A | * | 7/1999 | Andrews ..... 340/909 |
| 5,933,093 | A | | 8/1999 | Austin, II |
| 6,011,492 | A | | 1/2000 | Garesché |
| 6,087,961 | A | | 7/2000 | Markow |
| 6,157,321 | A | | 12/2000 | Ricci |
| 6,236,336 | B1 | * | 5/2001 | Oliva et al. ..... 340/901 |
| 6,252,519 | B1 | | 6/2001 | McKenna |

* cited by examiner

*Primary Examiner*—John Tweel
(74) *Attorney, Agent, or Firm*—Middleton Reutlinger

(57) ABSTRACT

An Emergency Vehicle Detection System having a transmitter system for use in an emergency vehicle and a receiver system for use in a non-emergency vehicle. The transmitter system generates and transmits two distinct unmodulated continuous wave signals. The receiver system detects the presence and strength of the continuous wave signals, and produces DC voltage signals which are proportional to the strength of the received continuous wave signals. The DC voltage signals are used to generate a warning signal when both DC voltage signals reach a predetermined level for a predetermined amount of time (to prevent false alarms) and maintain the warning signal for a predetermined amount of time should one of the DC voltage signals fade (fading minimization). Additionally. DC voltage signals arc used to oscillate the warning signal at a rate which is proportional to the strength of the received continuous wave signals.

13 Claims, 5 Drawing Sheets

RECEIVER BLOCK DIAGRAM

EMERGENCY VEHICLE DETECTION SYSTEM

CROSS-REFERENCE TO RELATED APPLICATIONS

This application claims priority base on U.S. Provisional Patent Application No. 60/334,427, filed Nov. 30, 2001.

STATEMENT REGARDING FEDERALLY SPONSORED RESEARCH OR DEVELOPMENT

Not Applicable

BACKGROUND OF THE INVENTION

1. Field of the Invention

This invention relates to emergency vehicle detection systems, and, in particular, pertains to a radio frequency transmitter and receiver system for alerting the operator of a vehicle to the presence of emergency vehicles in the vicinity.

2. Description of Related Art Including Information Disclosed under 37 CFR 1.97 and 37 CFR 1.98

A deadly game is being played on the nation's roads as emergency vehicles navigate through traffic to get to their destination. This results in delayed response times in time-critical situations, and, on occasion, the emergency vehicles are involved in traffic accidents. Some drivers simply are not aware that an emergency vehicle is in the vicinity due to being preoccupied with cell-phones or car radios, or simply because of the high levels of sound proofing that exists in many of today's vehicles.

Numerous designs for emergency vehicle detection and notification have been offered, as indicated by the large volume of an in this area. However, to date, there has been no widespread implementation of an emergency vehicle detection system. Issues that must be addressed by an acceptable system include reliability and cost efficiency.

BRIEF SUMMARY OF THE INVENTION

Thus, it is an object of the present invention to provide an emergency vehicle detection system utilizing two distinct signals and enable logic in the receiver to prevent false triggering of an alert.

It is a further object of the invention to provide an emergency vehicle detection system which generates an alert signal in the non-emergency vehicle which provides an indication of the relative distance of the emergency vehicle.

It is yet a further object of the invention to provide an emergency vehicle detection system which utilizes simple, inexpensive components and circuit designs so that the system can be implemented in both emergency and non-emergency vehicles without large expenses for the owners of such vehicles.

DETAILED DESCRIPTION OF THE INVENTION

Figure 1:
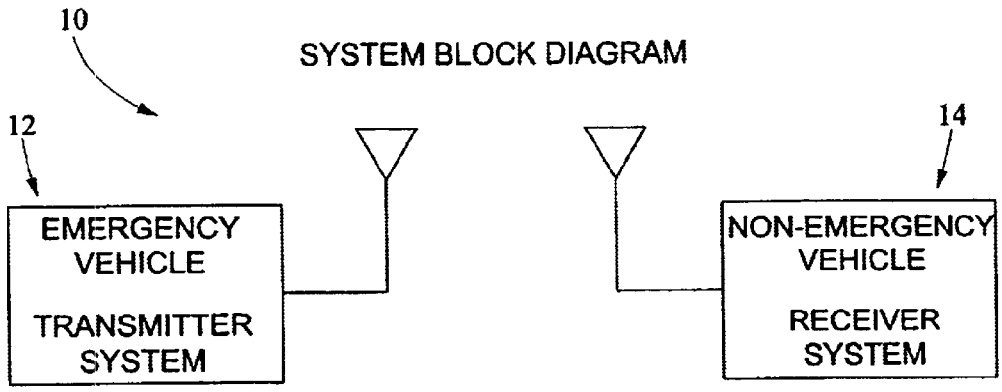
FIG. 1 is a block diagram of the emergency vehicle detection system of the present invention.

As shown in FIG. 1, the emergency vehicle detector system 10 has two major systems, a transmitter system 12 located in an emergency vehicle, and a receiver system 14 located in a non-emergency vehicle. The system is designed such that the transmitter system 12 is to be active only when the emergency vehicle is conducting an emergency run. The receiver system 14, however, is to be active anytime the non-emergency vehicle is operating.

Figure 2:
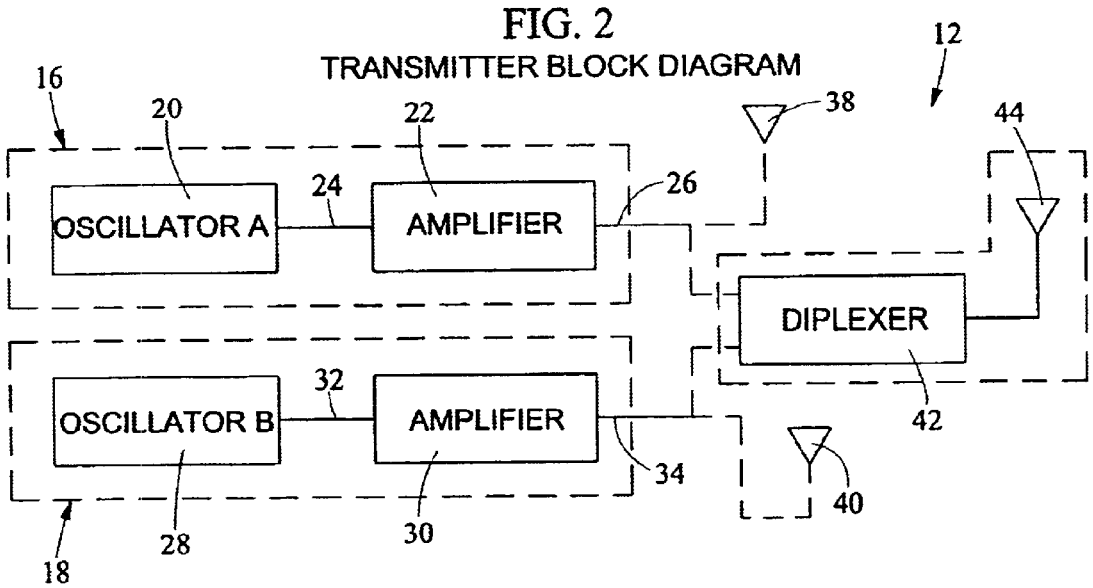
FIG. 2 is a block diagram of a transmitter system of the present invention.

The transmitter system 12, shown in FIG. 2, has a first transmitter sub-system 16 and a second transmitter sub-system 18. The two transmitter sub-systems are tuned to transmit distinct unmodulated continuous wave signals in the VHF band. Since VHF band transmissions are strictly line of sight, the selection of VHF band transmissions will insure that the emergency and non-emergency vehicles must be relatively close for the signals to be received. Also, by requiring both distinct signals to be present at the receiver to activate an alert, the system is more reliable than a single frequency system.

The first transmitter sub-system has a first oscillator 20 and a first amplifier 22. The first oscillator 20 generates a first frequency signal 24. The first frequency signal 24 is then input into the first amplifier 22, which increases the signal strength of the first frequency signal 24, generating amplified first frequency signal 26.

Second transmitter sub-system 18 has a second oscillator 28 and a second amplifier 30. The second oscillator 28 generates a second frequency signal 32, which in the preferred embodiment is separated from the first frequency signal 24 by about two megahertz (2 MHz), however the amount of separation between the signals can be any adequate frequency separation. The second frequency signal 32 is then input into the second amplifier 30, which increases the signal strength of the second frequency signal 32, generating amplified second frequency signal 34.

Figure 3:
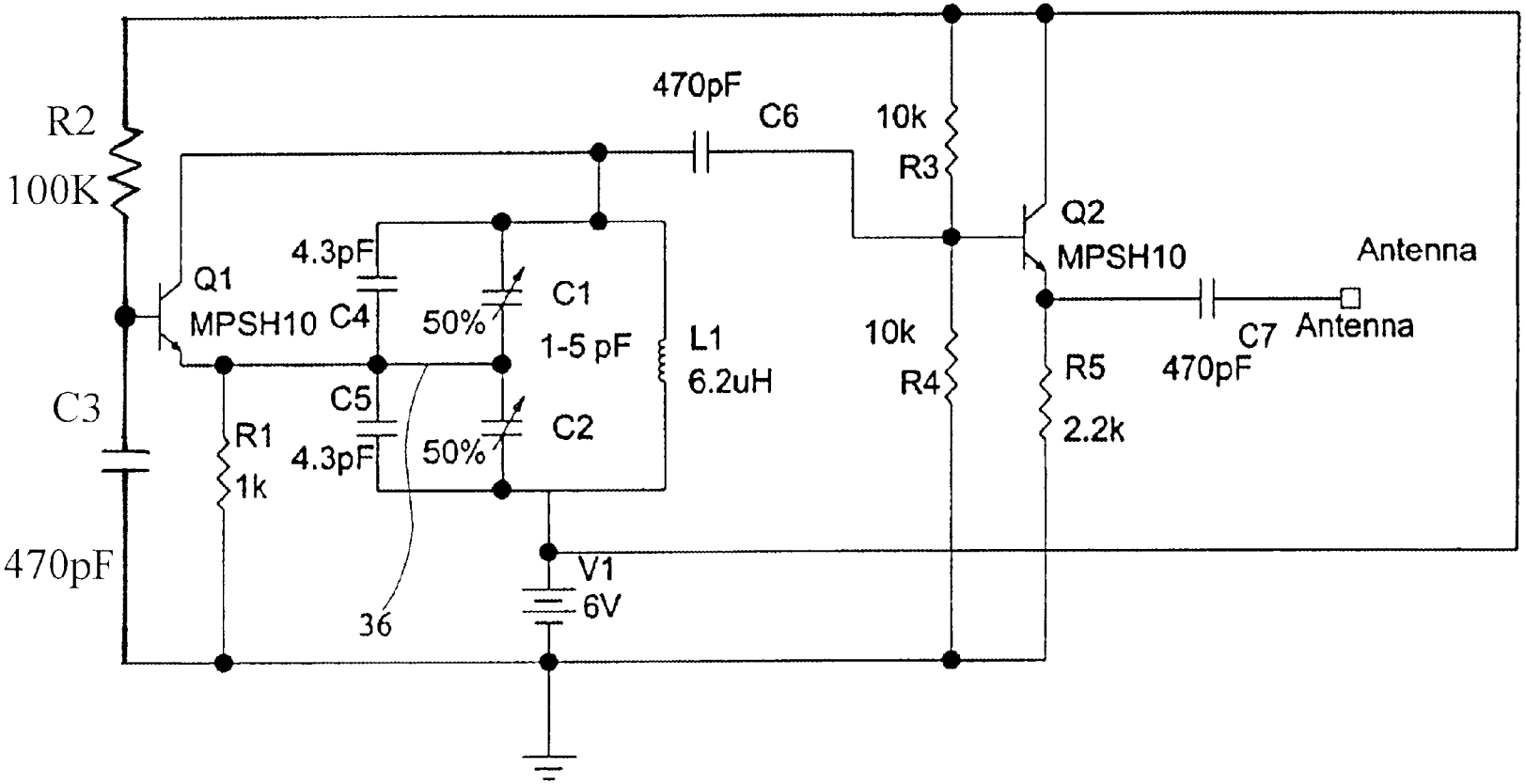
FIG. 3 is an electrical schematic of a representative transmitter circuit of the present invention.

FIG. 3 shows a representative electrical schematic of a tunable transmitter that is suitable for use for use as the first transmitter sub-system 16 and the second transmitter sub-system 18 of the invention. It is a slight variation on a very simple and cost efficient Colpitt's Oscillator having two amplifier stages and a resonant parallel tank circuit. R1 provides emitter bias and R2 provides base bias for amplifying transistor Q1. The three components R1, R2 and Q1 satisfy the Barkhausen criteria of gain X losses=1.

Continuing with the representative transmitter of FIG. 3, components C1, C2, C4, C5 and L1 are a resonant parallel tank circuit set for a resonant frequency. The tap 36 between C1/C4 and C2/C5 provides positive feedback to sustain the oscillation.

C6 provides DC isolation between the stages while feeding the signal through to the emitter follower (common collector) amplifier. C3 is a RE by-pass capacitor which not only shunts noise to ground, but also allows a higher RP gain for the amplifier. PS and R4 establish a base bias, and R5 provides an emitter bias for amplifying transistor Q2. The output is taken off the emitter of Q2 through 07, which provides DC isolation. The emitter follower amplifier increases the power of the signal while matching the 200–300 ohm output impedance of the oscillator to the 50 ohm, or so, impedance of an antenna. The emitter follower amplifier also provides isolation so that variations in the antenna are not reflected back into the oscillator. This keeps the oscillation frequency stabilized.

In another embodiment of the invention, the resonant parallel tank circuit could be replaced with a crystal oscillator for stability, while continuing to utilize an emitter follower amplifier for impedance matching and antenna isolation.

As mentioned above, the amplified frequency signals 26, 34 are coupled to an antenna for transmission. Returning to FIG. 2, amplified first frequency signal 26 may be directly applied to a first transmitting antenna 38, and amplified second frequency signal 34 may be directly applied to a second transmitting antenna 40. Alternatively, amplified frequency signals 26, 34 may be input into a diplexer 42. Diplexer 42 acts as a filter which allows amplified first and second frequency signals 26, 34 to pass through to a single diplexer antenna 44 without affecting either transmitter's final amplifier 22, 30.

Figure 4:
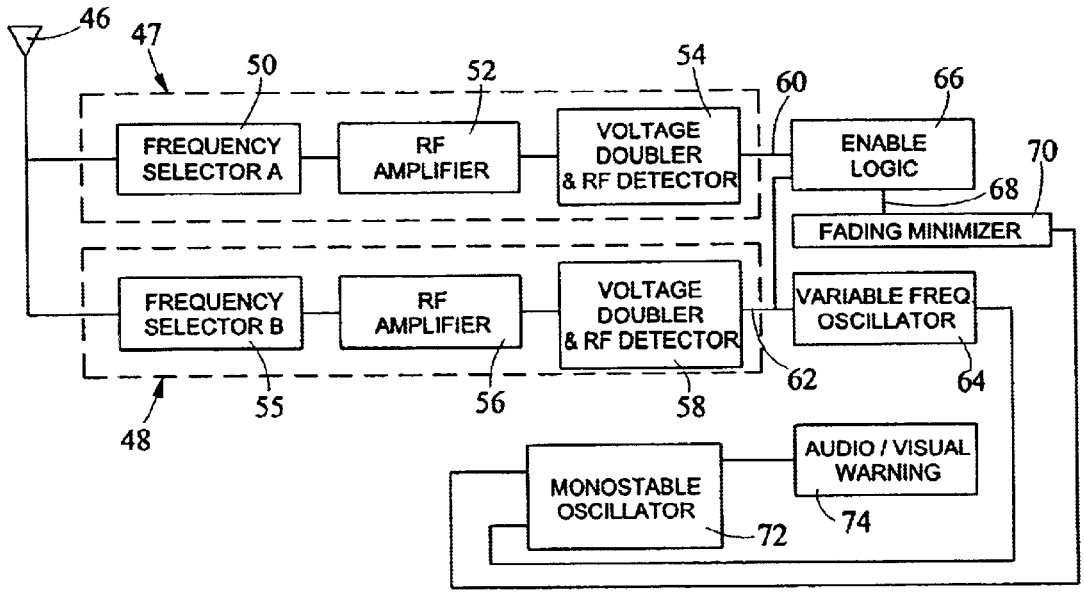
FIG. 4 is a block diagram of a receiver system of the present invention.

As shown in FIG. 4, the receiver system 14 includes a single receiving antenna 46 which provides the input to a first receiver sub-system 47 and a second receiver sub-system 48. The first receiver sub-system 47 is configured to detect the presence of the amplified first frequency signal 26, and the second receiver sub-system 48 is configured to detect the presence of the amplified second frequency signal 34. The preferred embodiment of the invention utilizes Tuned Radio Frequency (TRF) type receivers for the first receiver subsystem 47 and the second receiver sub-system 48.

Thus, the first receiver sub-system has a first frequency selector 50 followed by a first RF amplifier 52 and a first voltage doubler/RF detector stage 54. The second receiver subsystem has a second frequency selector 55 followed by a second RF amplifier 56 and a second voltage doubler/RF detector stage 58. The outputs from the first and second voltage doubler/RF detector stages 54, 58 are a first DC voltage signal 60 and a second DC voltage signal 62, respectively, which are proportional to the input signal strength of their respective RF receiver sub-systems.

One of either the first DC voltage signal 60 or the second DC voltage signal 62 is then used to regulate a variable frequency oscillator 64 such that the output frequency from the oscillator is proportional to the strength of the received signal. Additionally, the first DC voltage signal 60 and the second DC voltage signal 62 are both input into an enable logic stage 66 which generates an enable signal 68 only if the appropriate signals are present at each receiver. The enable signal 68 is input into a fading minimization circuit 70 which will either: 1) temporarily prevent the enabling of a warning signal in the case that a false signal is received, or 2) keep the warning signal active in the case that the received signals momentarily fade due to interference from buildings. The fading minimized enable signal 68 and the output of the variable frequency oscillator 64 then combine to trigger a monostable oscillator 72 which turns an audio/visual output 74 on and off at a rate within the range of human perception.

Figure 5:
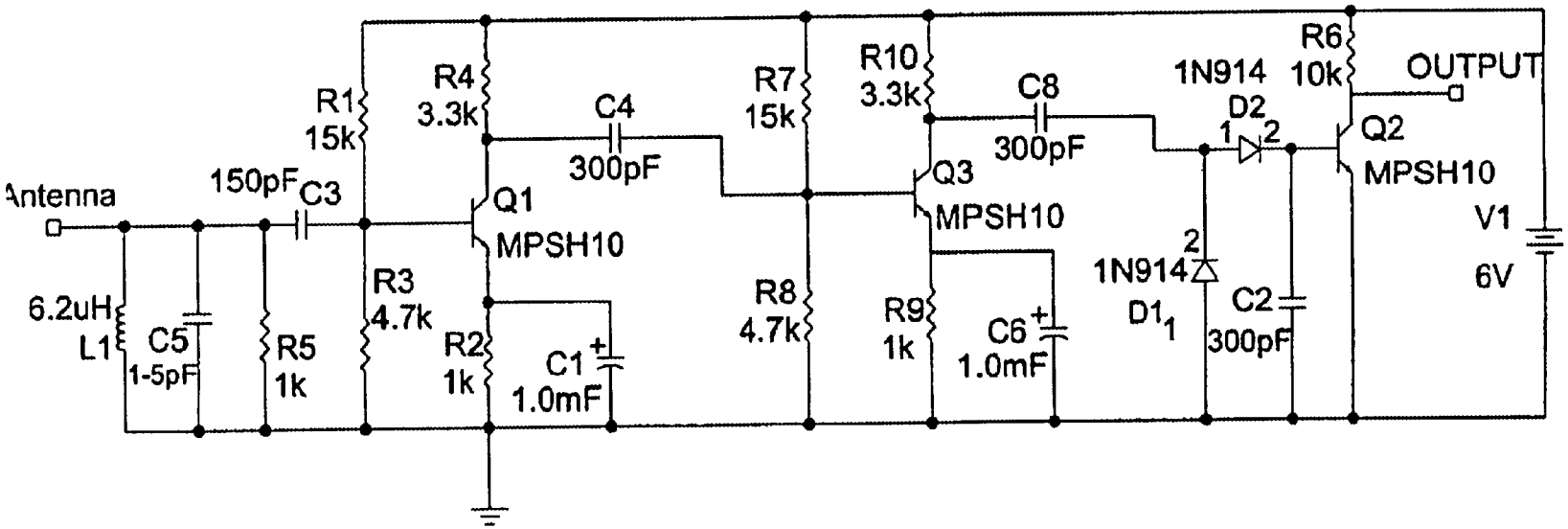
FIG. 5 is an electrical schematic of a representative receiver circuit of the present invention.

FIG. 5 shows a representative electrical schematic of a TRF type receiver circuit suitable for use as the receiver sub-systems of the invention. The frequency selector is formed by L1, C5 and C3. Together, L1 and C5 form a high-Q tank circuit bandpass filter, which is tunable by adjusting the values of L1 or C5. C3 serves as a DC blocking filter which passes the signal to the RF amplifier. The RF amplifier is two-stage transistor amplifier with R1, R2, R3, R4, C1, C4 and Q1 comprising the first stage and R7, R8, R9, R10, C6, C8 and Q3 comprising the second stage. The voltage doubler/RF detector is formed by C8, D1, D2, and C2. C8 and D1 form a voltage doubler. D2 rectifies the voltage doubled signal, and C2 filters the rectified signal to provide a DC voltage level proportional to the received signal. R6 and Q2 form a voltage inverter which provides an inverse voltage proportional to the DC voltage from the preceding stage.

Figure 6:
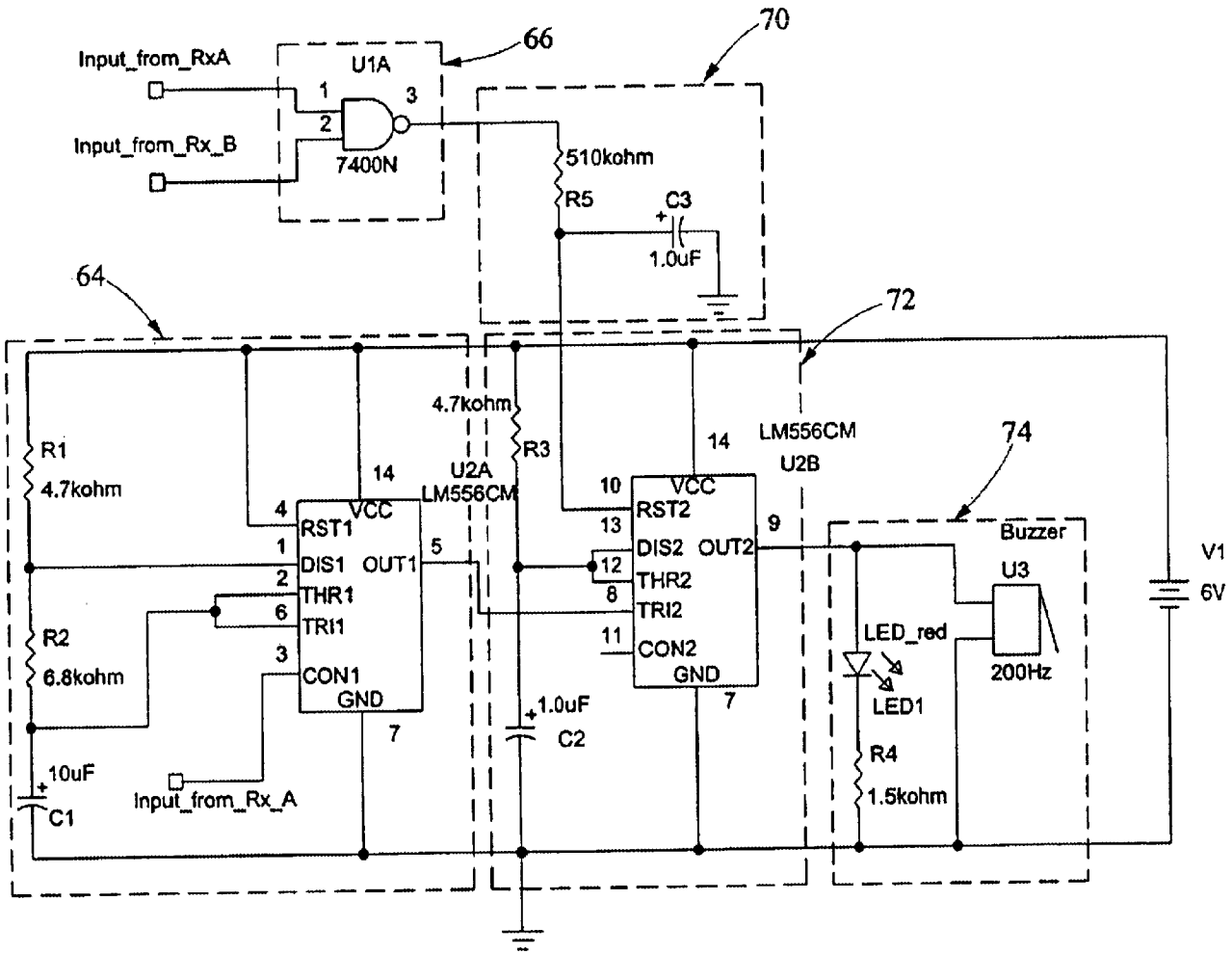
FIG. 6 is an electrical schematic of the enable logic, variable frequency oscillator and LED/buzzer sub systems of the present invention.

The outputs from the receiver sub-systems serve as the input to the enable logic stage 66, an embodiment of which is shown in FIG. 6 as U1A, a 7400N NAND gate. Thus, when both receivers have their respective input signals and the signals reach a predetermined level, the voltages on the inputs to U1A drop below 0.8 V and U1A provides a 6 volt DC output signal to the fading minimization circuit 70.

FIG. 6 also shows one embodiment of the fading minimization circuit 70, being comprised of R5 and C3. In the preferred embodiment with the component values shown, C3 charges up through R5 in about 0.5 seconds. This insures that both signals must be there for at least 0.5 seconds to minimize false alerts. Also, it takes about 0.5 seconds for C3 to discharge so the effects of signal fading causing the alert cycling are minimized. The output from the fading minimization circuit serves as one of the enabling inputs to the monostable oscillator 72.

Additionally, as shown in FIG. 6, the second DC voltage signal 62 is also used as an input to the variable frequency oscillator 64, although, it should be recognized that the first DC voltage signal 60 could also be used in this capacity. In the embodiment shown in FIG. 6, the variable frequency oscillator has U2A, which is ½ of dual 555 timer IC LM556CM. In the configuration shown, the output of U2A will oscillate in proportion to the magnitude of the second DC voltage signal 62. The output from the variable frequency oscillator 64 then serves as the other enabling input to the monostable oscillator 72.

The embodiment of the monostable oscillator 72 shown in FIG. 6 is the second ½ of the dual 55 timer IC LM556CM. In the configuration shown, the outputs from the fading minimization circuit 72 and the variable frequency oscillator 64 serve as enabling inputs to the U2B, which is biased to produce a constant frequency signal which is used to drive an audio/visual output 74.

The audio/visual output 74 of the embodiment shown in FIG. 6 consists of light-emitting diode LED1 and R4, for producing a visual signal, and buzzer U3, for producing an audible signal. Thus, the audio visual output 74 will produce a constant frequency signal which oscillates at a rate which is proportional to the signal strength of one of the received continuous wave signals.

It should be noted that in the description of the system described herein, the use of either of the received signals in generating the variable frequency oscillation of the warning signal would produce equivalent outcomes.

The foregoing detailed description of the invention is presented for illustrative purposes only and should not be construed to limit the invention as claimed, as it will be readily apparent to those skilled in the art that design choices may be made changing the configuration of the emergency vehicle detection system without departing from the spirit or scope of the invention.

What is claimed is:

1. A system for emergency vehicle detection comprising:

a transmitter system for use in an emergency vehicle, said transmitter system having:

a first transmitter means for generating a first distinct unmodulated continuous wave signal;

a second transmitter means for generating a second distinct unmodulated continuous wave signal; and a transmission antenna means for transmitting said first continuous wave signal and said second continuous wave signal, said transmission antenna means connected to said first transmitter subsystem and said second transmitter subsystem;

a receiver system for use in a non-emergency vehicle, said receiver system having:

a receiving antenna means for receiving said first continuous wave signal and said second continuous wave signal;

a first receiver means for detecting the presence and strength of said first continuous wave signal and for producing a first DC voltage signal which is proportional to said strength of said first received continuous wave signal, said first receiver means connected to said receiving antenna means;

a second receiver means for detecting the presence and strength of said second continuous wave signal and for producing a second DC voltage signal which is proportional to said strength of said second received continuous wave signal, said second receiver means connected to said receiving antenna means;

means for generating a warning signal when both first DC voltage signal and second DC voltage signal reach a predetermined signal level for a predetermined amount of time and for maintaining said warning signal for a predetermined amount of time should one of said DC voltage signals fade, said warning signal oscillating at a rate which is proportional to the signal strength of said second DC voltage signal.

2. The system of claim 1 wherein said transmitter means utilize a resonant parallel tank circuit to generate said corresponding continuous wave signal.

3. The system of claim 1 wherein said transmitter means utilize a crystal oscillator to generate said corresponding continuous wave signal.

4. The system of claim 1 wherein said transmission antenna means has a first transmitting antenna to which said first continuous wave signal is applied, and wherein said transmission antenna means further has a second transmitting antenna to which said second continuous wave signal is applied.

5. The system of claim 1 wherein said transmission antenna means has a diplexer circuit to which said first continuous wave signal and said second continuous wave signal are applied, and a diplexer antenna for transmitting said continuous wave signals, said diplexer antenna connected to said diplexer circuit.

6. The system of claim 1 wherein said receiver means utilize a Tuned Radio Frequency type receiver circuit.

7. The system of claim 6 wherein said receiver means further comprises a voltage doubler/RF detector followed by a voltage inverter, wherein said DC voltage signals are inversely proportional to said strength of said received continuous wave signals.

8. The system of claim 7 wherein said warning signal generating means further comprises enable logic means for generating an enable signal when both first DC voltage signal and second DC voltage signal reach said predetermined signal level.

9. The system of claim 8 wherein said enable logic means is a 7400N NAND gate, whereby said predetermined signal level is the level which causes the voltages on the inputs to said NAND gate to drop below 0.8 volts.

10. The system of claim 8 wherein said warning signal generating means further comprises fading minimization means for delaying said enable signal until said enable signal is present for said predetermined amount of time and for maintaining said enable signal until said enable signal is absent for said predetermined amount of time.

11. The system of claim 10 wherein said fading minimization means is a RC circuit with component values choosen such that a time constant for said RC circuit is substantially 0.5 seconds.

12. The system of claim 10 wherein said warning signal generating means further comprises a variable frequency oscillator means for generating an oscillating signal in proportion to said second DC voltage signal.

13. The system of claim 12 wherein said warning signal generating means further comprises a monostable oscillator for producing a constant frequency signal in the range of human perception for driving an audio/visual output, said monostable oscillator being enabled by said enable signal and said proportional oscillating signal, whereby said warning signal generating means produces a constant frequency signal which oscillates at a rate which is proportional to said second DC voltage signal.

* * * * *

UNITED STATES PATENT AND TRADEMARK OFFICE

CERTIFICATE OF CORRECTION

PATENT NO. : 6,778,101 B2
APPLICATION NO. : 10/305496
DATED : August 17, 2004
INVENTOR(S) : Turbeville It is certified that error appears in the above-identified patent and that said Letters Patent is hereby corrected as shown below:

Column 1, line 35, delete “an” and insert - - art - -

Column 2, line 46, delete second usage of “for use”

Column 2, line 61, change “RE” to “RF”

Column 2, line 62, change “RP” to “RF”

Column 2, line 63, change “PS” to “R3”

Column 2, line 65, change “07” to “C7”

Column 4, line 52, add “*I*” between “audio visual”

Signed and Sealed this

Twenty-second Day of August, 2006

JON W. DUDAS
*Director of the United States Patent and Trademark Office*